United States Patent [19]

Wibom

[11] 4,071,100

[45] Jan. 31, 1978

[54] METHOD OF MAKING HOLES OF SELECTED EXTERNAL CONFIGURATION IN PREFERABLY ROCK OR GROUND FORMATION, AND A DRILLING MACHINE FOR CARRYING OUT THE METHOD

[76] Inventor: Gustaf Hakan Oscar Wibom, Skogsvagen 12, Lidingo, Sweden, 181 41

[21] Appl. No.: 690,723

[22] Filed: May 27, 1976

[30] Foreign Application Priority Data

May 29, 1975 Sweden ..... 7506169
Sept. 30, 1975 Sweden ..... 7510957

[51] Int. Cl.[2] ..... E21B 5/00; E21B 7/00; E21B 17/00

[52] U.S. Cl. ..... 175/69; 175/325; 175/326; 175/415; 175/416; 175/91

[58] Field of Search ..... 175/69, 71, 91, 95, 175/96, 325, 326, 415, 416, 65, 57

[56] References Cited

U.S. PATENT DOCUMENTS

| | | | |
|---|---|---|---|
| 374,137 | 11/1887 | Arp | 175/91 |
| 2,177,300 | 10/1939 | Kellegren | 175/325 X |
| 2,683,021 | 7/1954 | Brauer | 175/91 |
| 2,942,850 | 6/1960 | Heath | 175/96 |
| 3,170,527 | 2/1965 | Norton | 175/326 |
| 3,297,099 | 1/1967 | Adams et al. | 175/96 |
| 3,509,949 | 5/1970 | Kukihara | 175/91 X |
| 3,682,258 | 8/1972 | Kelly, Jr. et al. | 175/96 |

FOREIGN PATENT DOCUMENTS

| | | | |
|---|---|---|---|
| 254,548 | 9/1964 | Australia | 175/325 |
| 1,338,995 | 8/1963 | France | 175/96 |
| 208,102 | 3/1909 | Germany. | |
| 365,022 | 3/1974 | Sweden. | |

*Primary Examiner*—Stephen J. Novosad
*Attorney, Agent, or Firm*—Fleit & Jacobson

[57] ABSTRACT

In a method of making holes of selective external configuration in a rock or earth formation, two or more rotatable drills provided with drill crowns are driven into the ground. The drill crowns are so arranged that they will touch each other or are radially spaced a small distance from each other and are substantially on the same level. The drill crowns are simultaneously axially displaced while they are rotated each about its own axis only. The drill crowns sit on drill rods provided with guide means such as tubes which are driven into the ground substantially simultaneously as the drill crowns. The guide means may be connected together to form a single common guide structure. When drilling two or more holes situated adjacent one or more previously drilled holes, a guide means having spacer means is inserted into a previously drilled hole, said spacer means guiding the drill for the further holes relative to the previously drilled hole by engagement with the residual walls of the drilled hole. The invention also refers to a drilling machine comprising two or more drill crowns for carrying out the above method.

16 Claims, 10 Drawing Figures

METHOD OF MAKING HOLES OF SELECTED EXTERNAL CONFIGURATION IN PREFERABLY ROCK OR GROUND FORMATION, AND A DRILLING MACHINE FOR CARRYING OUT THE METHOD

In Swedish layout print No. 365,022 there is described a guide arrangement for guiding one or more drills with which a series of closely adjacent holes can be drilled, said holes forming together a deep trench or a slot in which a tongued wall can be placed. The drill arrangement can also be used to make trenches of arcuate, circular, rectangular configuration etc.

The drill arrangement requires the use of sensing means which, during a drilling operation, sense the contours of one or more previously drilled holes. The guide arrangement and the sensing means are securely connected to each other and are movably carried by the drill or drills at a point located inwardly of the active working bit of the crown of the drill and are arranged, during a drilling operation, to accompany the drill or drills in the hole or holes throughout the depth thereof, thereby to guide the bit or bits in mutual spaced relationship and at the correct distances relative to the sensed hole or holes.

Such a drill arrangement is often suitable for the job in hand, but has the disadvantage that drilling must be effected in several different stages.

Other types of drilling machines for similar purposes are described in Swedish Pat. No. 313,030, German Pat. No. 208,102, French Pat. No. 1,021,992 and U.S. Pat. Nos. 836,494, 2,016,068, 2,942,850, 3,297,099 and 3,870,113. German layopen print No. 1,533,625 and U.S. Pat. No. 3,195,661 describe further state of the art.

In all these machines the drills are supported in a rotatable body, column, drill head or the like which is driven into the ground and which carries the drill crowns. However, there is in these arrangements always the risk of uneven wear of the drill crowns which is a serious drawback.

An object of the invention is to provide ways and means whereby holes of selected external configuration can be made in a more simple and economical manner in rock or ground formation.

According to the invention there is accomplished a method of making holes of selective external configuration in a rock or earth formation, comprising the steps of driving into the ground two or more rotatable drills provided with drill crowns, each of which being arranged to drill a hole, which holes together have a smaller total area than the area of the finished hole, positioning the drill crowns so that they will touch each other or are radially spaced a small distance from each other and are substantially on the same level and simultaneously displacing the drill crowns axially while rotating the drill crowns each about its own axis only.

When drilling is effected in this manner, with the active cutting bits of the drill crowns lying substantially on a common plane and rotating each about its own axis only, holes of simple or complicated external configuration can be drilled possibly in a single step and without uneven wear of the drill crowns.

A preferred method of applying the invention is one in which the drill crowns are arranged on drill rods provided with guide means, the guide means being driven into the ground substantially at the same time as the drill crowns.

Normally, the guide means create large frictional forces against the ground, but owing to the fact that said guide means are driven into the ground substantially simultaneously with the drill crowns, disadvantages associated with such friction are eliminated. In addition, when applying the method it is possible to use simple standard drill-machine equipment; in addition the guide means can be constructed in an extremely simple manner and may comprise simple tubes which are optionally connected one to the other.

Thus, in one method of applying the invention, the guide means are driven into the ground whilst jointed together to form a single common guide structure.

In this way there can be used a plurality of sinker drills each of which is accommodated in an outer tube which serves as a guide. Adjacent tubes, for example, may be welded together. With this method of applying the invention, the guide means obtain a substantially passive roll; they move downwardly together with the sinker drills but can not be said to effect any active stoping work. Instead, the guide means or the common guide structure for the drill or drills will guide the same relative to the walls of the drilled hole or holes during a drilling operation.

In an alternative way of applying the invention there is used one or more jointing sleeves arranged along the drill rods, said sleeves cleaning the walls of the hole during a drilling operation. In this embodiment, the guide structure or guide means has or have a more active part in a drilling operation, in that the guides are used for stoping so as to remove any intermediate walls which may be present between drilled holes.

When the drill rods are rotated are driven into the ground by means of compressed air, which contains a lubricant, it is preferred that part of the compressed air-lubricant mixture is used to effect lubrication between the guide means and the sinker drill and the guide means and the drill rod, respectively.

Particularly in the case of repeated drilling, in order to provide a recess of selected shape in practice, certain problems have been encountered, these problems being mainly related to the guiding of the drill bits in subsequent drilling operations.

Thus, it has been found difficult to use one or more of the previously drilled holes for the guiding of subsequent drilling operations, primarily because of collapsed parts of the rock or earth formation and the friction which the guide means exert on the wall of the previously drilled holes.

However, these problems can be solved in a simple and efficient manner by inserting, when drilling two or more holes adjacent to one or more previously drilled holes, a guide means provided with spacer or distance means into a previously drilled hole, said spacer means guiding the drills for the further holes relative to the previously drilled holes by engagement with the remaining walls of the drilled holes.

The guide means can be readily inserted to the intended depth, which will reduce the amount of power consumed as a result of the considerable reduction in friction between the outer surface of the guide means and the previously drilled hole, at the same time as positive and accurate guidance of the drills for further holes relative to said previously drilled holes is obtained.

When a particular accurate guide is required, two or more guide means provided with distance means and joined together are inserted into a corresponding number of previously drilled holes. In this way the additional possibility is afforded of guiding the drill bits in a desired manner relative to the previously drilled holes during a drilling operation.

The invention also relates to a drilling machine for carrying out the method, the characterising features of the drilling machine being disclosed in the claims.

So that the invention will be more readily understood and optional features thereof made apparent, exemplary embodiments of the invention will now be described with reference to the accompanying schematic drawings; in which.

Figure 5:
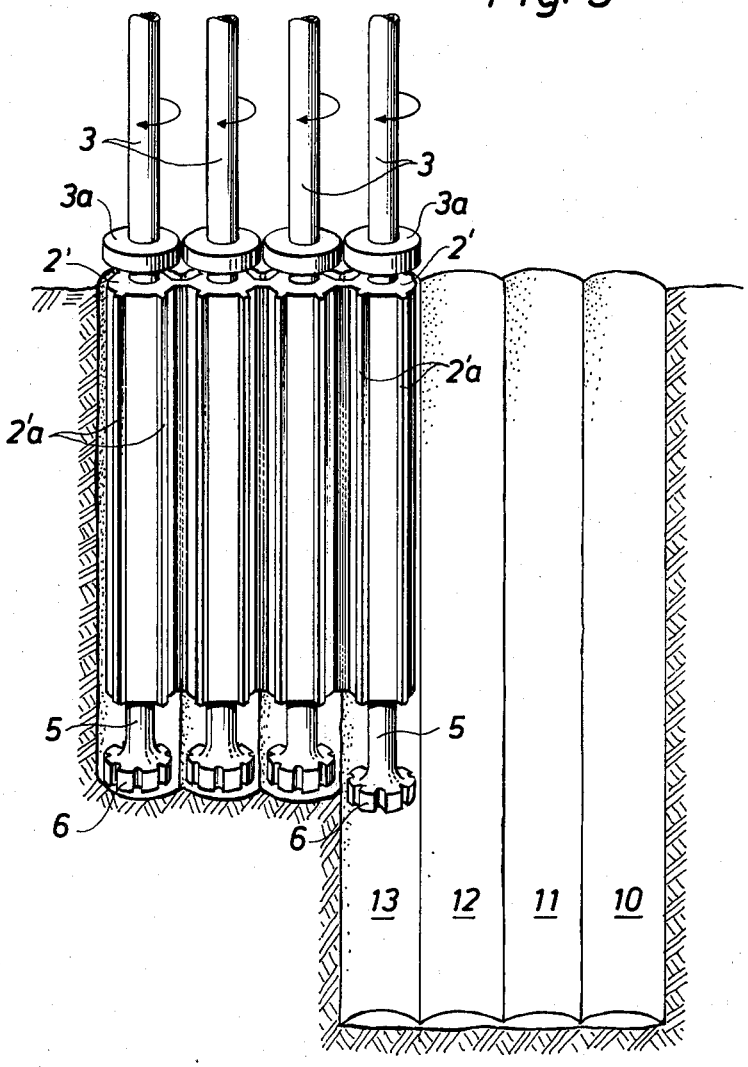

FIGS. 4*a–f* illustrate examples of different shapes of holes which can be made by means of a method and a machine according to the invention;

FIG. 5 is a cutaway view in perspective, illustrating drilling during a second stage of the making of a substantially rectalinear recess by means of four sinker drills, each of which is accommodated in a surrounding guide means. A previously drilled hole is used to guide the drills, said drills making a further three adjacently arranged holes.

Figure 1:
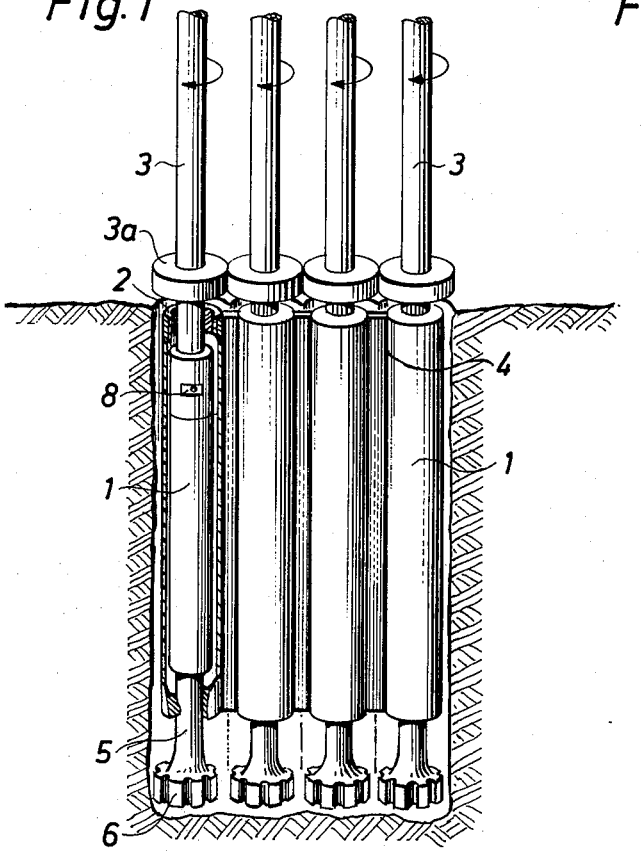
FIG. 1 is a perspective view illustrating the drilling of a substantially rectalinear slot by means of four sinker drills, each of which is accommodated in a surrounding guide means.

FIG. 1 shows part of a drilling machine having four adjacently located sinker drills 1 each of which is accommodated in an outer tube 2, which tube serves as a guide for the sinker drills. The sinker drills are caused to rotate by means of four jointed drill rods 3 which are driven by an external power source not shown. Compressed air or some other driving fluid, such as oil, is passed to the sinker drills via the jointed rods 3.

The guides 2, which may comprise simple tubes, are suitably jointed together as by welding.

The reference 5 indicates a shaft or neck of a drill crown 6. The reference 8 indicates a lubricating means for the sinker drill 1. Arranged on the jointed rods 3 are fin-like flanges 3*a* which are arranged to clean the walls of a drilled hole from earth, stones etc. falling thereinto. With such a drill arrangement, the guides obtain a substantially passive roll, since the drill crowns are forced into the ground after the guides. The guides cannot therefore be said to carry out any active stoping work.

The drill arrangement, however, affords the simple possibility of drilling holes of different external profile by joining the guides together in any suitable manner so as to provide a slot of desired form. The weld joints 4 between the tubes 2 contribute to cleaning the drilled holes. The drill arrangement is particularly suited for drilling rock, since the aforementioned considerable friction will not act on the guides since they are not subjected to impact.

Figure 2:
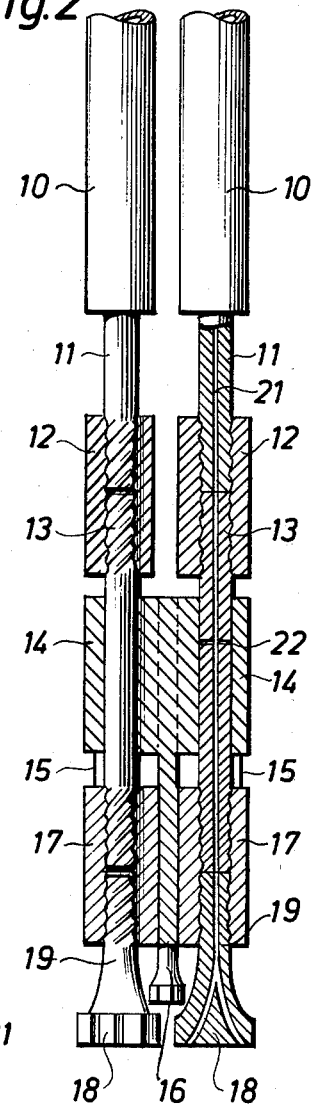
FIG. 2 illustrates an alternative embodiment in which each one of two sinker drills co-acts with a respective drill rod having associated jointing sleeve which are arranged to effect an impact action against underlying guide means.

With the alternative embodiment shown in FIG. 2 the sinker drills 10 are located above the surface of the ground and do not accompany the movement of the drill crowns. Instead, each sinker drill 10 is provided with a so-called neck adaptor 11 which is joined to a jointed rod 13 through a jointing sleeve 12.

The jointing sleeves 12 are arranged to exert impact forces against the underlying guides 14 of the jointed rods 13.

Arranged beneath the guides 14 are separate stoping means 15, 16. The jointed rods 13 are connected with the necks 19 of respective drill crowns 18 through further, lower jointing sleeves 17. Flushing liquid is applied to a flushing hole 22 in the region of the guides and to the drilling crowns 18 through a central passage 21.

This embodiment is considered to be more flexible than the embodiment of FIG. 1. The guides 14 obtain a more active roll in the cleansing of the drilled hole since they are hammered downwardly by the jointly sleeves 12. This embodiment is therefore particularly suited for drilling in earth and loose rock.

The drill arrangement can be driven by a conventional machine place above the surface of the ground to be drilled.

With the embodiment of FIG. 2 there is provided a small axial clearance between the guides. This means that the guides can not be subjected to impact forces when they are held so tightly as to prevent them from being lifted.

When a guide meets an obstacle, it will lift the overlying jointing sleeve upwards. The guide is thus able to crush the obstacle in its path. This additional force is provided by the sinker drill 10 which act on the guides 14 through the jointing sleeves 12.

When the drill itself meets an obstacle, the guides are not lifted. Lifting of the guides only takes place when the guides themselves encounter an obstacle.

Figure 3:
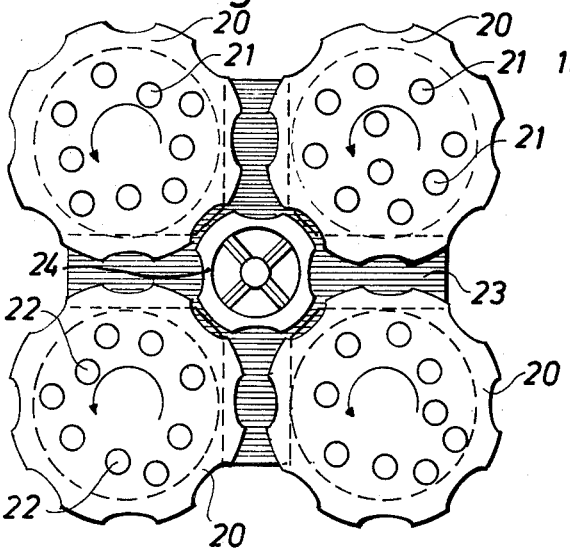
FIG. 3 is a bottom plan view of a modified embodiment having four drill crowns rectangularly arranged and intermediate stopping means.

In FIG. 3 there is shown a drill arrangement comprising four drill crowns 20 arranged in the form of a rectangle. The drill crowns are provided in a conventional manner with pegs 21 and flushing holes 22. Arranged between the drill crowns is a stoping device 23 in the form of a cross having a centrally arranged stoping means 24 serving as a drill crown, the diameter of which is smaller than the diameter of the drill crowns 20.

Figure 4:
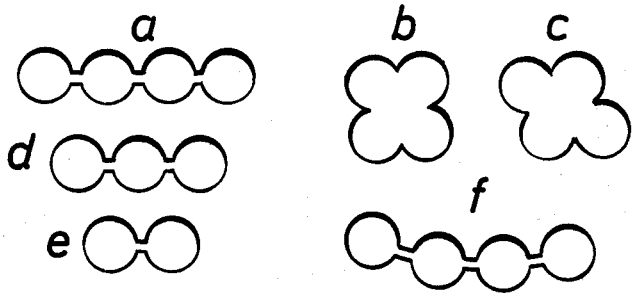

FIG. 4 shows a number of examples of hole configurations which can be produced when applying a method according to the invention. These configurations are only examples, and many other configurations than those shown are conceivable.

FIG. 5 shows part of the drilling machine having four adjacently located sinker drills 1, each of which is accommodated in a surrounding guide means 2' which means are constructed in a specific manner. The sinker drills are caused to rotate by means of four jointed rods 3 which are driven by an external power source (not shown). Compressed air or some other form of working fluid, such as oil, is supplied to the sinker drills through the jointing rods 3.

The reference 5 indicates the shaft or neck of a respective sinker drill 6. The references 10 and 13 identify adjacently located hole which have previously been drilled with the four sinker drills. During the drilling operation, the walls between the adjacently lying previously drilled holes have been removed so as to form a continuous recess.

With the illustrated embodiment, all guide means 2' are provided with a number of distance means 2'*a* in the form of radially and axially extending projection or flanges on on the outer surface of the guide means.

The flanges 2'*a* of the drill inserted in the previously drilled hole 13 engage the residual walls of the holes so as to guide the entire drilling arrangement relative to said hole 13, whereby all drill bits 6 are centred and aligned relative to the axis of previously drilled holes. Owing to the fact that solely said flanges or distance means 2'a engage the walls of the holes, there is obtained a considerable reduction in frictional losses during a drilling operation.

Further, owing to the fact that with the illustrated embodiment all guide means 2' are provided with spacer or distance means in form of flanges, these also contribute to stoping of the drilled holes.

If a more accurate guiding is desired, two or more guide means provided with distance means can be inserted in the previously drilled holes. The additional advantage is also afforded of guiding the drill bits which are to drill fresh holes in a desired manner, e.g. having a certain inclination relative to the previously drilled holes. The guide means of the drill rod are, in this case, capable of being adjusted angularly relative to the guide means inserted in the previously drilled holes (not shown).

It will readily be seen that the spacer or distance means have a form other than axially extending flanges. Optionally, the distance means may comprise elements which are separate to the guide means. In certain cases, they need not extend axially but may be more or less punctilinear.

By way of example of the advantages afforded by the invention it can be mentioned that a drill crown used in practice and having a diameter of 25 cm costs 35,000 Sw. Cr. (May 1976). When applying the method according to the invention, the same effect can be obtained by using four smaller crowns of standard design arranged in a square-like configuration, these crowns costing together 5,000 Sw. Cr. For the sake of completeness it must, of course, be noted that the costs for the guide means etc. must be added to this sum. Nevertheless, it will be seen that this additional cost is negligable in relation to the gain obtained through the invention with respect to the cost of the drill crowns.

What I claim is:

1. A method of making holes of selective external configuration in a rock or earth formation, comprising the steps of providing two or more rotatable drills each provided with drill crowns, by arranging the drill crowns on drill rods and providing guide means around said drill rods, each drill crown being arranged to drill a hole, which holes together have a smaller total area than the area of the finished hole, positioning the rotatable drills adjacent to each other so that the drill crowns will touch each other or are radially spaced a small distance from each other and positioning the rotatable drills so that the drill crowns are substantially on the same level with each other, driving said rotatable drills into the ground, simultaneously displacing the drill crowns axially while rotating each of the drill crowns about its own axis only, and driving the guide means into the ground substantially simultaneously with the drill crowns.

2. A method according to claim 1, further comprising the steps of connecting the guide means together to form a single common guide structure and driving said single common guide structure into the ground.

3. A method according to claim 2, comprising connecting the guide means together by providing a small axial clearance between separate portions of the guide means.

4. A method according to claim 1, further comprising guiding the guide means on the rods while maintaining the guide means adjacent to the walls of a previously drilled hole.

5. A method according to claim 1, further comprising the steps of arranging one or more jointing sleeves along the drill rods and said driving step comprises using said jointing sleeves to clear the walls of a hole during the drilling operation.

6. A method according to claim 1, and using the guide means as hole stoping means during the drilling operation, thereby to remove any intermediate walls which may be present between the drilled holes.

7. A method according to claim 1, and arranging each drill crown to co-act with a respective sinker drill, and driving said sinker drills into the ground while each sinker drill is located within an associated guide means.

8. A method according to claim 1, wherein said rotating and driving step comprises providing compressed air which contains a lubricant to said rotatable drills and using the compressed air-lubricant mixture to lubricate between said guide means and said drill rods.

9. A method according to claim 1, further comprising the steps of drilling two or more holes situated adjacent one or more previously drilled holes, wherein the method comprises providing spacer means on said guide means and driving said spacer means into a previously drilled hole, said spacer means guiding the drill for the further holes relative to the previously drilled hole by engagement with the residual walls of the drilled holes.

10. A method according to claim 9, and joining together two or more guide means provided with spacer means and inserting said guide and spacer means in a corresponding number of previously drilled holes.

11. A drilling machine comprising two or more rotatable boring means for boring holes, each of said boring means provided with a bore crown, drill rods, means for mounting the bore crowns on said drill rods, guide means for guiding the drill rods and means for joining the guide means to one another, means for positioning said bore crowns substantially at the same level and for arranging said bore crowns in such close adjacent relationship that they touch each other or are located at a small radial distance from each other, means for driving said bore crowns into the ground, means for axially displacing said bore crowns simultaneously with said driving means, means for rotating each bore crown about its own axis only, and a sinker drill wherein the guide means further comprises means for embracing said sinker drill.

12. A drilling machine according to claim 11, wherein adjacent guide means are joined together.

13. A drilling machine according to claim 11, wherein said guide means is provided with spacer means for engaging a wall of a drilled hole.

14. A drilling machine according to claim 13, wherein said spacer means comprises radially extending flanges mounted on an outer surface of said guide means.

15. A drilling machine according to claim 13, wherein said guide means comprises means for angular adjustment relative to the previously drilled holes.

16. A drilling machine comprising two or more rotatable boring means for boring holes, each of said boring means provided with a bore crown, means for positioning said bore crowns substantially at the same level and for arranging said bore crowns in such close adjacent relationship that they touch each other or are located at a small radial distance from each other, means for driving said bore crowns into the ground, means for axially displacing said bore crowns simultaneously with said driving means, for rotating each bore crown about its own axis only wherein said boring means comprises a plurality of sinker drills, neck adapter means connected to said sinker drills, jointed rods, jointing sleeve means for joining said neck adapter means to said jointed rods guide means located beneath the jointing sleeve means, wherein said guide means is subjected to an impact force from the jointing sleeve means.

* * * * *